US006478694B2

(12) United States Patent
Anderson et al.

(10) Patent No.: US 6,478,694 B2
(45) **Date of Patent: *Nov. 12, 2002**

(54) CUSTOMIZABLE GOLF PUTTER HEAD WITH FACE INSERT

(75) Inventors: Douglas W. Anderson, Glendale, AZ (US); Michael J. Nelson, San Jose, CA (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 32 days.

This patent is subject to a terminal disclaimer.

(21) Appl. No.: 09/767,995

(22) Filed: Jan. 23, 2001

(65) Prior Publication Data

US 2002/0098912 A1 Jul. 25, 2002

(51) Int. Cl.[7] ..... A63B 69/00
(52) U.S. Cl. ..... 473/350; 473/340
(58) Field of Search ..... 473/244, 245, 473/246, 247, 248, 251, 305, 306, 307, 313, 314, 340, 350, 288

(56) References Cited

U.S. PATENT DOCUMENTS

| | | | | |
|---|---|---|---|---|
| 5,190,290 A | | 3/1993 | Take | |
| 5,230,509 A | | 7/1993 | Chavez | |
| 5,275,413 A | | 1/1994 | Sprague | |
| 5,407,196 A | | 4/1995 | Busnardo | |
| 5,437,447 A | | 8/1995 | Rigutto | |
| 5,690,562 A | * | 11/1997 | Strum | 473/340 |
| 6,238,303 B1 | | 5/2001 | Fite | |
| 6,273,831 B1 | * | 8/2001 | Dewanjee | 473/324 |

* cited by examiner

*Primary Examiner*—Paul T. Sewell
*Assistant Examiner*—M. Chambers
(74) *Attorney, Agent, or Firm*—Darrell F. Marquette

(57) ABSTRACT

A customizable golf putter head includes a face member and a back body both of which may be selected from a plurality of differently configured face members and back bodies. The face member has a cavity formed in its rear surface and the back body has a mating section that is positioned within the cavity of the face member. A face insert is formed on the mating section of the back body and extends through an opening formed between heel and toe ends of the face member. A membrane positioned between the face member and the back body also has an opening through which the face insert extends.

4 Claims, 2 Drawing Sheets

CUSTOMIZABLE GOLF PUTTER HEAD WITH FACE INSERT

BACKGROUND OF THE INVENTION

This invention relates generally to golf putters and, in particular, to a golf putter head which may be customized to meet an individual golfer's preferences.

Since putting is such a highly individualistic aspect of golf, many configurations of putter heads are available to satisfy the preferences of the individual golfer. Putter head configurations vary significantly and may have some effect on a golfer's confidence and ability when putting.

Prior U.S. Pat. Nos. 5,407,196 to Busnardo; 5,437,447 to Rigutto; 5,230,509 to Chavez; and 5,275,413 to Sprague disclose two-piece putters which may be customized. The Busnardo and Rigutto patents both disclose specifically configured putter heads with interchangeable face plates for changing the loft angle of the ball striking face. The Chavez and Sprague patents both disclose putter heads with interchangeable rear weights for altering the weight and feel of the putter head.

Many putter heads made today have what is commonly referred to as a "face insert" which is placed in an impact area on the putter head face to provide a different feel when striking a golf ball. Face inserts may be formed of synthetic resin such as polyurethane while remaining portions of the putter head are formed of metal such as steel or bronze. A cavity having a desired shape and depth is provided in the impact area in the putter head face, and the face insert is installed in the cavity by either one of two well known methods. In one method, synthetic resin in a liquid state is poured into the cavity and is then cured so that the face insert is tightly bonded to the cavity. In another method, the face insert is preformed and then secured in the cavity by using a suitable adhesive such as epoxy. In both methods, the putter head may be milled after the face insert has been installed to provide a flat face across the putter head. A drawback of both of these methods is that they are time consuming and costly.

SUMMARY OF THE INVENTION

In accordance with the present invention, a customizable putter head is disclosed. The putter head includes a face member and a back body which may be selected from pluralities of differently configured face members and back bodies. The face member includes a hosel which extends upwardly for receiving one end of a golf shaft. A plurality of differently configured hosels may be provided. The face member has a front surface arranged for striking a golf ball and a rear surface. A cavity formed in the rear surface has a recessed bottom surface circumscribed by a rim surface. The face member has an opening between its heel and toe ends, and this opening extends from the front surface to the recessed bottom surface of the cavity.

The back body has a mating section with a shape which matches the shape of the cavity in the rear surface of the face member so that when the putter is assembled, the mating section of the back body will be disposed within the face member cavity. The back body also has a face insert which protrudes from the mating section and extends through the opening in the face member. The face member and the back body are attached to each other by a pair of screws, and a membrane may be placed in the cavity in the rear surface of the face member between the recessed bottom surface thereof and the mating section of the back body. The membrane has an opening through which the face insert on the back body extends.

DESCRIPTION OF THE PREFERRED EMBODIMENT

Figure 1:
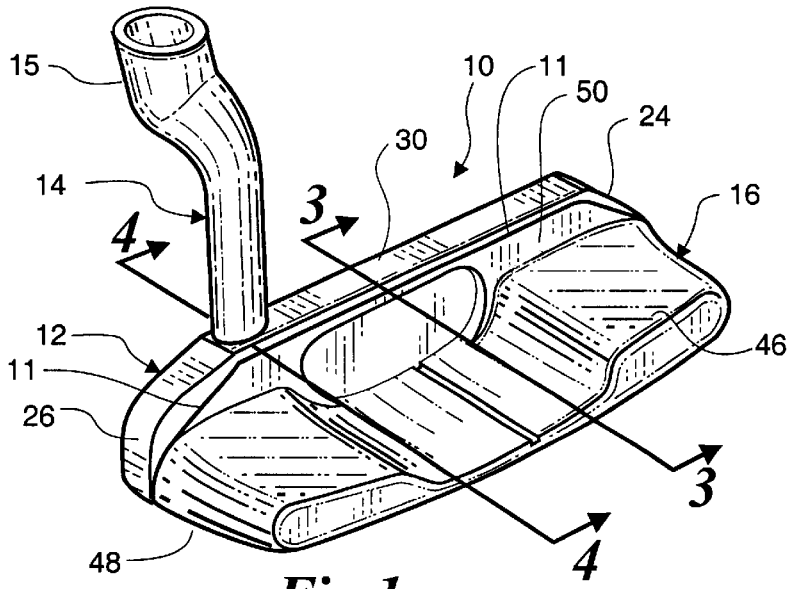
FIG. 1 is a perspective view of an assembled putter head according to one embodiment of the present invention.
Figure 2:
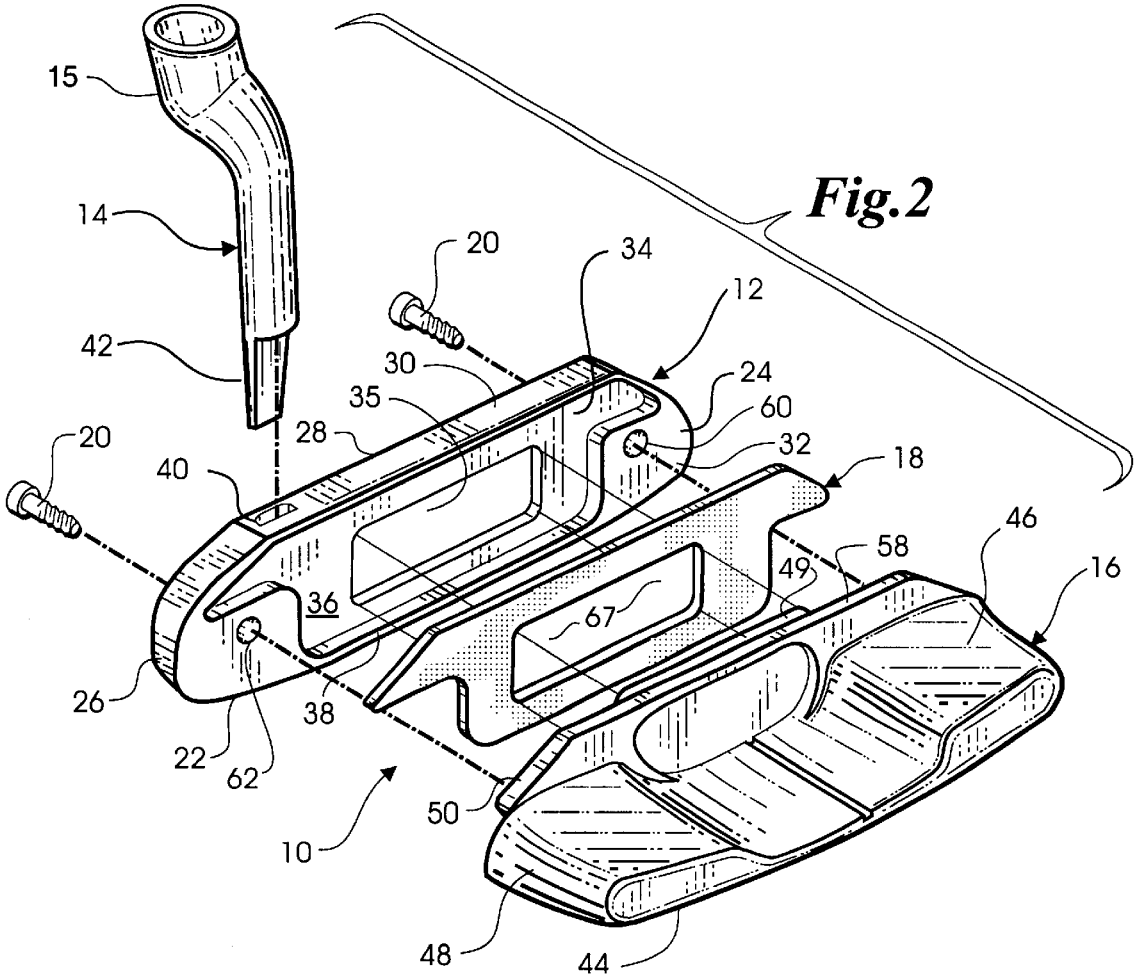
FIG. 2 is an exploded view of the putter head shown in FIG. 1.

Referring to FIG. 1, an assembled golf putter head according to one embodiment of the present invention is indicated generally by the reference numeral 10. The putter head 10, as shown in the exploded view of FIG. 2, is formed of multiple components including a face member 12, a hosel 14, a back body 16 and a membrane 18. These components are held together by a pair of screws 20. The hosel 14 has a boss 15 for receiving one end of a golf shaft (not shown).

Figure 4:
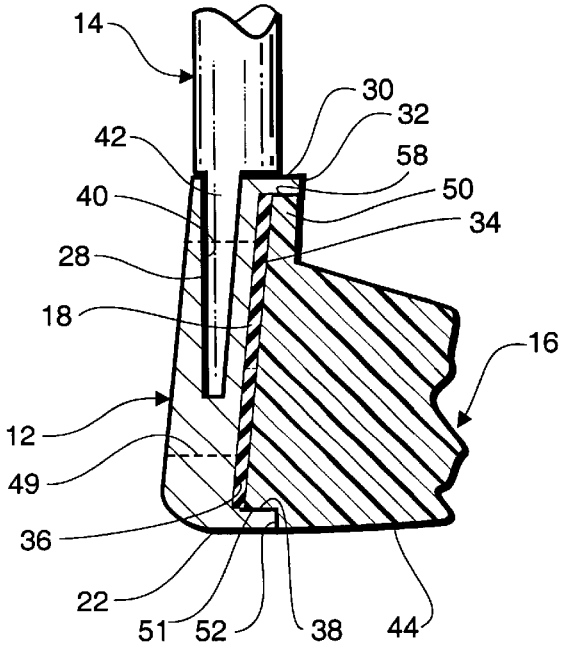
FIG. 4 is an enlarged fragmentary sectional view taken along the line 4—4 in FIG. 1.

The face member 12 has a sole 22, a toe end 24, a heel end 26, a front surface 28 arranged for striking a golf ball (not shown), a top ledge 30 and a rear surface 32. The top ledge 30 is disposed between the front and rear surfaces 28, 32. A cavity 34 is formed in the rear surface 32 with the cavity 34 having a recessed bottom surface 36 circumscribed by a rim surface 38. The face member 12 has an opening 35 formed therein between the toe and heel ends 24, 26 thereof The opening 35 extends from the front surface 28 to the recessed bottom surface 36 of the cavity 34. An upwardly opening socket 40 is formed in the top ledge 30 of the face member 12 for receiving a depending extension 42 of the hosel 14 as shown in FIG. 4. The face member 12 and the hosel 14 are preferably formed of suitable metal such as stainless steel. When both the face member 12 and the hosel 14 are formed of metal, a sintering process may be used to secure the hosel 14 to the face member 12. Alternatively, the hosel 14 may be formed of a suitable synthetic resin and secured to the face member 12 by using an adhesive such as epoxy. It will be apparent that by fabricating the face member 12 and the hosel 14 as separate components and securing them together in the manner indicated, different face members having desired configurations may be provided. The face member 12 is selected from a plurality of differently configured face members (not shown), and the hosel 14 is selected from a plurality of differently configured hosels (not shown). Alternatively, the face member 12 and the hosel 14 may be integrally formed.

Figure 5:
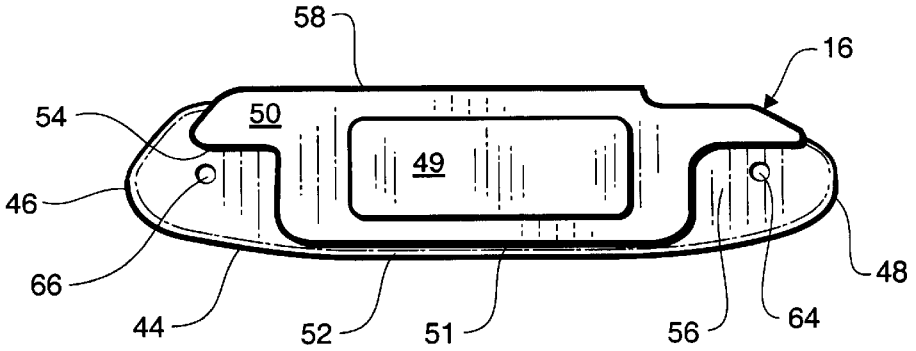
FIG. 5 is an elevational view of one component of the putter head shown in FIGS. 1 and 2.

The back body 16 has a sole 44, a toe end 46, a heel end 48 and a mating section 50 with a face insert 49 which is shown best in FIGS. 2 and 5. The mating section 50 of the back body 16 is separated along its lower edge 51 from the sole 44 by a lip 52 which extends between front end portions 54 and 56 of the back body 16. The mating section 50 has an elongated upper edge 58 opposite the lower edge 51. It is contemplated that a plurality of differently configured back bodies (not shown) will be fabricated to provide a selection of back bodies having various weights and shapes. The back bodies may be formed of any suitable material such as metal or synthetic resin. The mating section 50 of the back body 16 has a shape that matches the shape of the recessed bottom surface 36 of the face member cavity 34 to provide a proper fit when the face member 12 and the back body 16 are secured together as described below. The face insert 49 on the back body 16 extends through the opening 35 in the face member 12 and is coplanar with the front surface 28 when the putter head 10 is finished. The face insert 49 is sized to completely fill the opening 35 so that there are no gaps between the outer edges of the face insert 49 and the edges of the opening 35.

Figure 3:
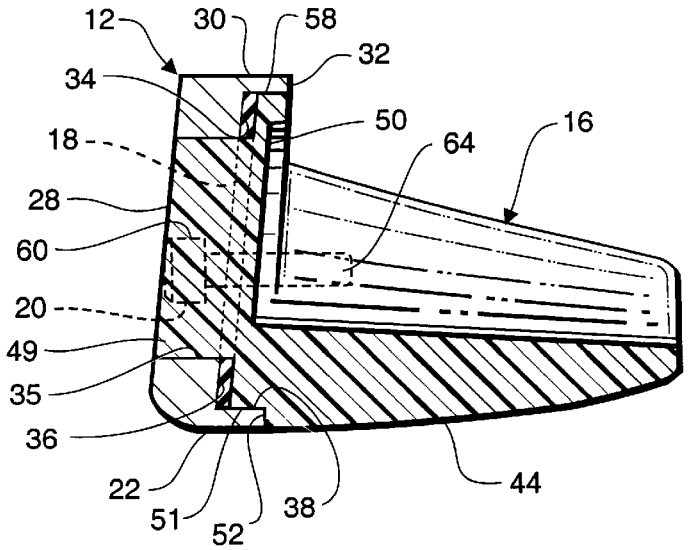
FIG. 3 is an enlarged sectional view taken along the line 3—3 in FIG. 1.

As seen in FIG. 2, the face member 12 is provided with a spaced apart pair of counterbores 60 and 62 formed proximate the toe and heel ends 24 and 26, respectively, with the counterbores 60, 62 extending from the front surface 28 through to the back surface 32. The back body 16 is formed with a spaced apart pair of threaded bores 64 and 66 (FIG. 5) adjacent the heel and toe ends 48 and 46, respectively, which are disposed to axially align with the counterbores 60, 62 in the face member 12 when the back body 16 is secured to the face member 12 by the screws 20. The mating section 50 of the back body 16 is disposed within the cavity 34 of the face member 12 with the upper edge 58 of the mating section 50 lying beneath the top ledge 30 of the face member 12 as shown in FIGS. 3 and 4. Therefore, a parting line 11 (FIG. 1) between the face member 12 and the back body 16 is concealed by the top ledge 30 and is not visible from directly above the putter head 10 such as when a golfer is making a putting stroke with a putter incorporating the putter head 10. Also, the face insert 49 on the back body 16 is disposed in the opening 35 in the face member 12.

Referring to FIG. 2, it will be understood that the membrane 18 is formed with a shape that matches the shape of the cavity 34 in the face member 12 and the shape of the mating section 50 of the back body 16. As seen in FIGS. 3 and 4, when the putter head 10 is assembled, the membrane 18 is interposed between the recessed bottom surface 36 of the cavity 34 of the face member 12 and the mating section 50 of the back body 16. The membrane 18 has an opening 67 through which the face insert 49 extends. The membrane 18 is preferably made of an elastomeric material such as foam tape which has adhesive on both sides and which may be die cut into the desired shape. Although the putter head 10 may be assembled without utilizing the membrane 18, it is preferred that the membrane 18 be used because it will absorb vibration and alter the sound made when a golf ball is struck on the face insert 49.

When the putter head 10 is assembled as described, the face insert 49 on the back body 16 will protrude through the opening 35 and extend beyond the front surface 28 of the face member 12. The front surface 28 along with the protruding face insert 49 is then milled to provide the finished putter head 10 with a flat face between the toe and heel ends 24, 26 of the face member

What is claimed is:

1. A golf putter head comprising:

a face member having a heel end, a toe end, a front surface arranged for striking a golf ball and a rear surface, said face member including a cavity formed in the rear surface with the cavity having a recessed bottom surface circumscribed by a rim surface, said face member having an opening between said heel and toe ends, said opening extending from said front surface to the recessed bottom surface of said cavity;

a back body mounted on the rear surface of said face member, said back body having a mating section which is shaped so that it is disposed within the cavity formed in the rear surface of said face member, said back body also having a face insert protruding from the mating section thereof and extending through the opening in said face member; and a membrane disposed in the cavity formed in said face member and positioned between said face member and said back body, said membrane having an opening through which the face insert on said back body extends.

2. The golf putter head of claim 1, further comprising said membrane being interposed between the recessed bottom surface of the cavity of said face member and the mating section of said back body.

3. A golf putter head comprising:

a face member having a heel end, a toe end, a front surface arranged for striking a golf ball and a rear surface, said face member including a cavity formed in the rear surface with the cavity having a recessed bottom surface circumscribed by a rim surface, said face member having an opening between said heel and toe ends, said opening extending from said front surface to the recessed bottom surface of said cavity;

a back body mounted on the rear surface of said face member, said back body having a mating section which is shaped so that it is disposed within the cavity formed in the rear surface of said face member, said back body also having a face insert protruding from the mating section thereof and extending through the opening in said face member; and the mating section of said back body having a shape that substantially matches a shape of the cavity formed in the rear surface of said face member.

4. A golf putter head comprising:

a face member having a heel end, a toe end, a front surface arranged for striking a golf ball and a rear surface, said face member including a cavity formed in the rear surface with the cavity having a recessed bottom surface circumscribed by a rim surface, said face member having an opening between said heel and toe ends, said opening extending from said front surface to the recessed bottom surface of said cavity;

a back body mounted on the rear surface of said face member, said back body having a mating section which is shaped so that it is disposed within the cavity formed in the rear surface of said face member, said back body also having a face insert protruding from the mating section thereof and extending through the opening in said face member; and a pair of screws for securing said face member and said back body together.

* * * * *